United States Patent [19]

Deaver

[11] Patent Number: 4,790,409

[45] Date of Patent: Dec. 13, 1988

[54] MUFFLER WITH REVERSE FLOW PASSAGES

[75] Inventor: Don A. Deaver, Jackson, Mich.

[73] Assignee: Tenneco, Inc., Lincolnshire, Ill.

[21] Appl. No.: 50,152

[22] Filed: May 14, 1987

[51] Int. Cl.[4] ..... F01N 1/08

[52] U.S. Cl. ..... 181/265; 181/266

[58] Field of Search ..... 60/312; 181/265, 266, 181/272

[56] References Cited

U.S. PATENT DOCUMENTS

| | | | |
|---|---|---|---|
| 1,988,048 | 1/1935 | Peik . | |
| 2,009,343 | 7/1935 | Peik . | |
| 3,086,611 | 4/1963 | Nelson | 181/265 |
| 3,353,628 | 11/1967 | Gilbert | 181/265 |
| 3,370,674 | 2/1968 | Jettinghoff | 181/265 |
| 4,185,715 | 1/1980 | Boiu | 181/266 |

*Primary Examiner*—Douglas Hart

*Attorney, Agent, or Firm*—Harness, Dickey & Pierce

[57] ABSTRACT

An automotive muffler has sound attenuating means in the form of one or more frame subassemblies which are formed of two identical transverse partitions and two identical longitudinal partitions secured at opposite ends to the transverse partitions and acting with them and the muffler housing to provide a retroverted exhaust gas flow path.

20 Claims, 4 Drawing Sheets

MUFFLER WITH REVERSE FLOW PASSAGES

BRIEF SUMMARY OF THE INVENTION

This invention relates to sound attenuating mufflers of the type used in the exhaust gas systems of motor vehicles.

It is a purpose of the invention to provide a relatively light weight, compact, acoustically efficient, durable, muffler construction of round cross section.

The invention accomplishes this purpose by means of a novel subassembly in the form of a frame that can be inserted into a round tubular muffler housing to subdivide the interior of the housing into a plurality of interconnected parallel gas flow paths that extend longitudinally of the housing and define a triflow or retroverted gas passage connecting the inlet at one end of the muffler housing to the outlet at the other end of the housing.

In preferred form, the frame comprises two transverse partitions that are identical and two longitudinal partitions that are identical. The transverse partitions are at opposite ends of the frame and the longitudinal partitions are rigidly affixed to each other and to the transverse partitions. When this is done, the frame can be inserted into a uniform diameter tube that is to form the muffler housing. Then the opposite ends of the tube can be deformed or swaged into inlet and outlet bushings thereby completing the construction of the muffler. Different acoustic effects can be achieved by positioning the frame in different longitudinal positions. Frames of different lengths may be constructed for insertion in housings of correspondingly different lengths to provide mufflers of different lengths for different applications. Also, a plurality of frames may be inserted into one housing to increase sound attenuation by providing a plurality of triflow gas passage systems in one muffler.

DETAILED DESCRIPTION OF THE PREFERRED EMBODIMENTS OF THE INVENTION

Figure 1:
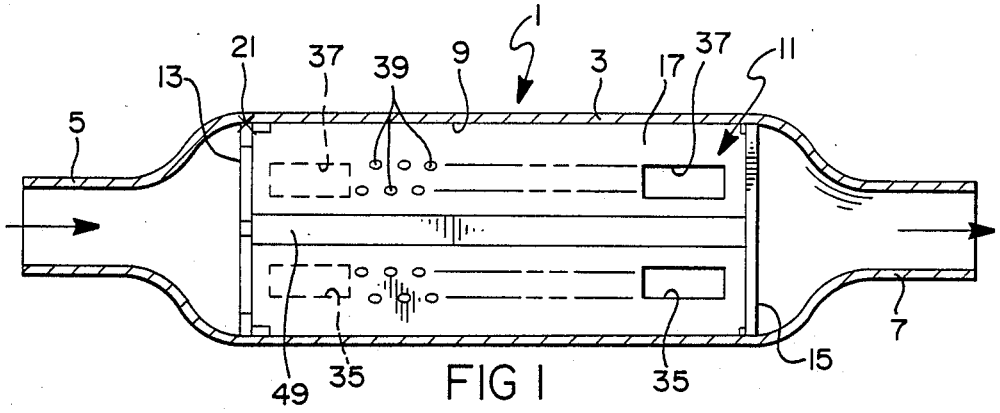
FIG. 1 is somewhat schematic longitudinal cross section through an exhaust gas muffler embodying the invention.

FIG. 1 shows a basic embodiment of the invention comprising a muffler 1 having a metallic round tubular housing 3 of uniform diameter throughout most of its length but swaged down at its left end to form an integral inlet bushing 5 and at its right end to form an integral outlet bushing 7, the bushings serving as means to connect the muffler 1 to gas flow conduits (not shown) in an exhaust gas system, as is well known. The interior of housing 3 comprises a chamber 9 and prior to formation of at least one of the bushings 5 or 7 a preassembled unitary metal frame or subassembly 11 is inserted into the chamber 9. It defines a substantially round cylindrical envelope and is substantially coaxial with the housing. The frame 11 includes a round transverse inlet partition 13 adjacent the inlet bushing 5 and a round transverse outlet partition 15 adjacent the outlet bushing 7, each partition having a slide contact and substantially gas tight fit with the inside surface of housing 3. The frame 11 also includes back-to-back substantially V-shaped longitudinal partitions 17 and 19 (see FIGS. 5 and 6) that are welded at opposite ends to the partitions 13 and 15. Partition 13 (and therefor frame 11) may be fixed in longitudinal position by spotwelding or the like to the housing 3 as indicated by the "x" at 21.

In operation, exhaust enters the muffler by way of bushing 5 and flows down the length of frame 11 to the outlet partition 15. There it is forced by the frame to reverse direction and flow backwards along the length of the frame 11 (through different passages) to the inlet partition 13. There it is forced by the frame to reverse direction again and flow along the length of the frame 11 for the third time (and through still another passage) and then out of the muffler through bushing 7.

Figure 9:
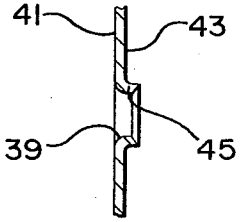
FIG. 9 is a cross section along the line 9—9 of FIG. 7.

The structure of frame 11 that produces the retroverted flow pattern just described as shown in more detail in FIGS. 4-11. The partitions or baffles 17 and 19 are identical in structure and each may be formed from a flat sheet metal blank 21 having the construction shown in FIG. 7. The blank is essentially rectangular and symmetrical about a longitudinal center line 23. However, the four corners of the blank are sheared out as indicated by the rectangular cutouts 25. Two identical rectangular spotweld tabs 27, equally spaced from the center line 23 on opposite sides of it, project from the left (inlet for partition 17) end edge 29 of the blank 21. Similarly, two identical rectangular spotweld tabs 31, longitudinally aligned with tabs 27, project from the right (outlet for partition 17) end edge 33 of the blank 21. Relatively large identical rectangular (with rounded corners) gas flow openings or ports 35 and 37 are sheared from the blank and they are transversely aligned and located equal distances from the center line 23 and on opposite sides of it. A relatively large number of small holes 39 are formed in identical patterns of a desired type in the blank on opposite sides of the center line 23, as shown. The holes are punched from the top face 41 to the back face 43 of the blank and flash or metal round the edge of each hole is intentionally formed so that there are short circular necks 45 around each hole 39 (FIG. 9).

Figure 7:
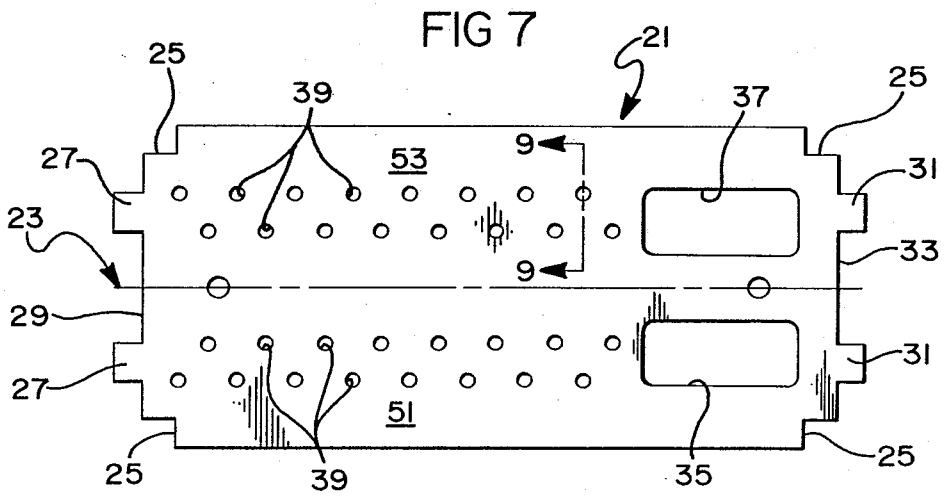
FIG. 7 is a plan view or layout of the pressed flat sheet metal blank used to form each of the longitudinal partitions.
Figure 8:
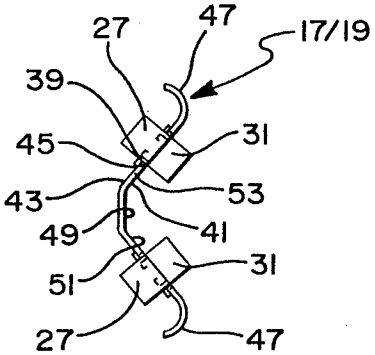
FIG. 8 is an end view of the blank of FIG. 7 after it is bent along several parallel longitudinal axes into the final shape for assembly with another (and identical) longitudinal partition and with the transverse end partitions.

Three changes are made to the blank 21 as just described and as shown in FIG. 7 to convert it to the partition 17 or 19. First, the opposite longitudinal side edge portions are bent toward the back face 43 on a radius to form curved longitudinal side flange portions 47. Second, the tabs 27 and 31 are bent to extend at right angles to the plane of the blank 21 with the tabs 27 extending away from the rear face 43 and the tabs 31 extending away from the front face 41 (see FIG. 8). Third, while retaining a longitudinal, rectangular, flat base and center strip 49, the opposite sides 51 and 53 of the blank are bent along parallel longitudinal axes at angles of substantially 40 degrees to the strip 49 upwardly or in the direction of the top face 41 to give a trough or V-shaped (included angle about 100 degrees) to the blank converting it into partition 17 or 19.

Figures 4, 5, 6:
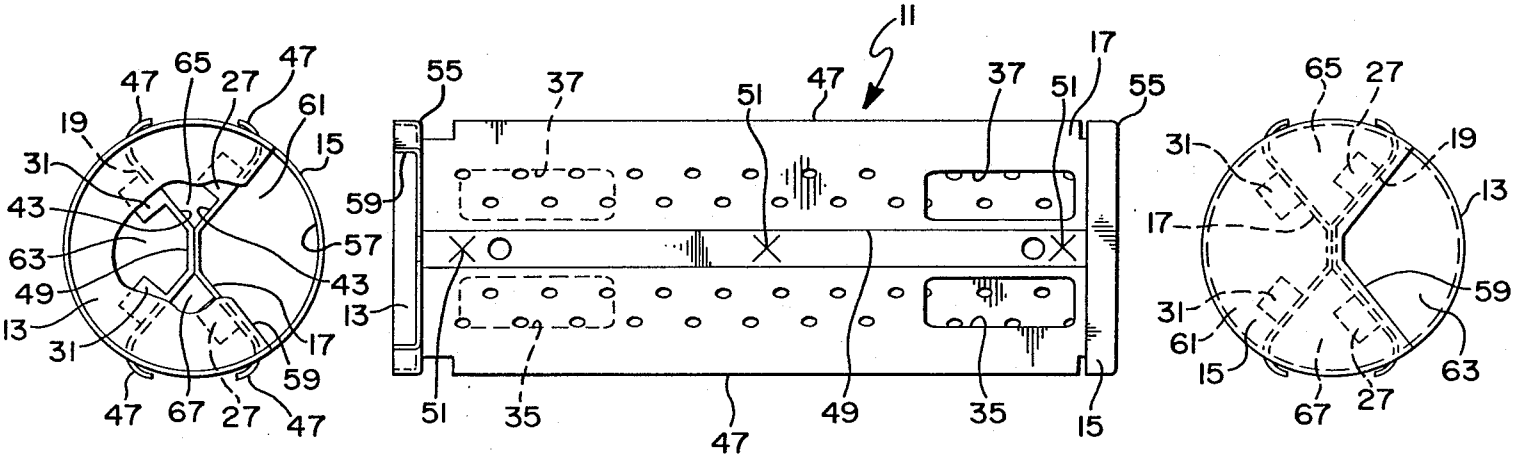
FIG. 4 is a side elevation of the frame of FIG. 1 (or of FIGS. 2 and 3) showing it prior to but ready for insertion into the housing, preferably into the left end of the housing.
FIG. 5 is an end elevation taken from the left of FIG. 4 and shows the inlet end of the frame.
FIG. 6 is an end elevation taken from the right of FIG. 4 and shows the outlet end of the frame.

At assembly, partitions 17 and 19 formed from blanks 21 are placed back to back with the strips 49 of each in contact and spotwelded together as indicated by the "x" 51 (FIG. 4). However, the inlet partition 17 has the openings 35 and 37 at the right end and the outlet partition 19 has its openings 35 and 37 at the left end, i.e. partition 19 is reversed end for end from partition 17, as illustrated by the dashed lines for its openings in FIG. 4.

Figure 11:
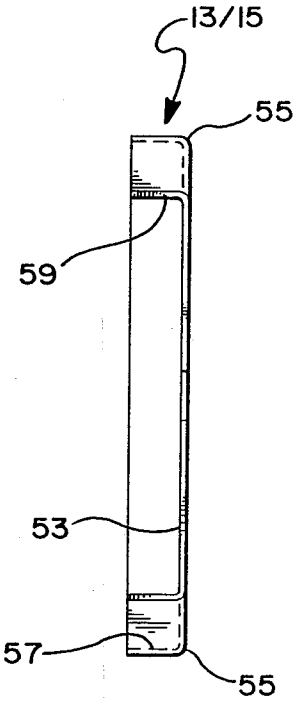
FIG. 11 is a side elevation taken from the right of FIG. 10.
Figure 10:
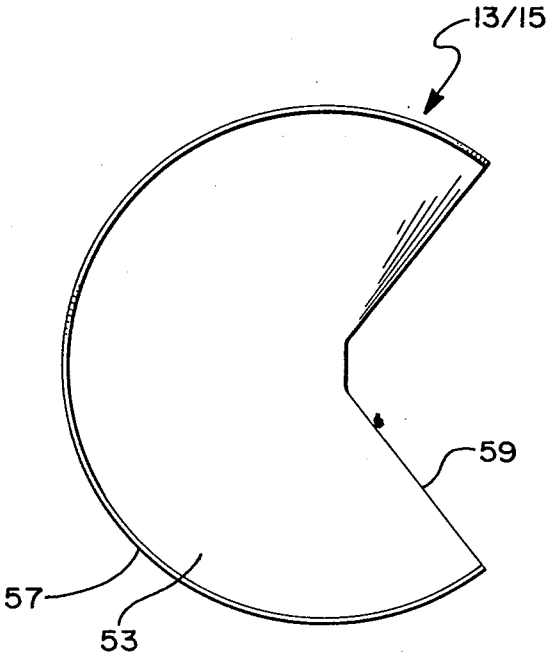
FIG. 10 is a plan view of one of the transverse partitions of the frame (it being noted that the two partitions are identical)

As seen in FIGS. 10 and 11, the transverse partitions 13 and 15 each comprise a substantially circular imperforate flat metal plate 53 with the outer edge bent at substantially a right angle corner 55 to form a peripheral flange 57. The plate 53 and flange 57 have a V-shaped or pie-shaped cut-out opening 59 corresponding substantially in size and shape to the V-shape of the longitudinal partitions 17 and 19.

In assembly of the transverse partitions 13 and 15 to the already back-to-back assembled longitudinal partitions 17 and 19, the cutout 59 of inlet partition 13 is aligned with the V-shape of partition 17 while the cutout 59 of the outlet partition 15 is aligned with the V-shape of the partition 19. The partitions 13 and 15 are brought into contact with the tabs 27 and 31 of the partitions 17 and 19 and the tabs are spotwelded to the plates 53 of the transverse partitions to form the frame 11. The outer diameters of the transverse partitions 13 and 15 are such that the partitions have a sliding contact on the inner diameter of the housing 3 and thus are in substantially gas tight engagement with the housing. To facilitate stuffing of the frame 11 into the housing 3, the partitions 13 and 15 are positioned so that their slightly rounded corners 55 face in the same direction, this direction being the anticipated direction of insertion into the housing. For example, the corners 55 in the frame 11 as illustrated in FIG. 4 are on the right or outlet ends of the two partitions 13 and 15 thereby facilitating insertion of the frame into the inlet or left end of housing 3 while it is still in the form of a uniform diameter tube. This means that the inlet end 5 will have to be reduced in diameter to bushing 5 after the frame 11 has been inserted. The outlet end can be reduced in diameter to bushing 7 either before or after insertion of the frame.

The outer edges of the curved longitudinal side flange portions 47 of the partitions 17 and 19 are each located on a radius (with respect to the longitudinal axis of the housing 3) that is slightly larger than the radius of the inside wall of the housing 3. Thus, they have a gas-tight fit and will be elastically deflected radially inwardly when the frame 11 is stuffed inside of the housing 3. This provides a resilient, shock-absorbent radial pressure to help hold the frame 11 in position against movement relative to the housing and by resisting rattling, etc., also resists undesired mechanical noise.

Since the radii of the four curved flanges 47 are sligthly larger than the outer radii of the partitions 13 and 15, the function of the cutouts or notches 25 (FIG. 7) will become apparent. The cutouts reduce the lengths of the flanges 47 causing them to terminate longitudinally inwardly of both end edges 29 and 33. One end of each partition 17 and 19 must fit inside of one of the transverse partitions (partition 15 in FIG. 4) inasmuch as the transverse partitions face the same way and are identical and the longitudinal partitions are identical. Thus, the cutouts allow one end of partition 17 to fit inside of partition 15 and the opposite end of partition 19 to fit inside of partition 15 so that the tabs 31 and 27, respectively, can be welded to the partition.

In terms of the gas flow passage through the muffler, the frame 11 acts with the inside wall of the housing 3 to define four longitudinally extending gas flow passages. The first is an inlet passage 61 (FIGS. 5 and 6) defined by the V-shape of partition 17. The second is an outlet passage 63 (FIGS. 5 and 6) defined by the V-shape of the partition 19. The third and fourth are reverse flow passages 65 and 67 (FIGS. 5 and 6) defined by the two V-shaped spaces between the back faces 43 of the partitions 17 and 19. The inlet end of the inlet passage 61 is reached by gas flowing from inlet bushing 5 through the aligned V-shaped cutout 59 in partition 13. The outlet end of outlet passage 63 is aligned with the V-shaped cutout 59 in the partition 15 to allow gas to flow from the frame 11 to the outlet bushing 7.

In terms of operation of the muffler 1, gas enters the inlet bushing 5 and flows as a main flow stream into the upstream end of chamber 9 where it encounters a substantial enlargement in diameter of the gas flow path. It then encounters a reduction in width of the path as it goes through main flow stream V-shaped cutout 59 in inlet partition 13 to enter the upstream or inlet end of longitudinal inlet passage 61. At the downstream or outlet end of inlet passage 61, the gas encounters outlet partition 15 and is forced to leave the passage 61 through large main flow stream openings or ports 35 and 37 to enter the two longitudinal reverse flow passages 65 and 67 at their upstream ends which are adjacent the outlet end of the frame 11 and the downstream end of inlet passage 61. Both a reduction in width and then an expansion in width are experienced by the gas in going through the ports 35 and 37 into passages 65 and 67 along with the effects of separation from one into two gas streams. Gas in passages 65 and 67 flows back toward the inlet end of the muffler until it is forced by inlet partition 13 to flow through main flow stream ports or openings 37 and 35, respectively, in partition 19 to enter the upstream (inlet end) end of longitudinal outlet passage 63. Again, the gas is subjected to a reduced width path as it goes through ports 35 and 37 and then expansion as it enters the passage 63. There is also a recombination of the two gas streams from passages 65 and 67 into a common gas stream in passage 63. The gas then flows down passage 63 and through pie-shaped main flow stream cutout 59 in outlet partition 15 where it expands into a short section of chamber 9 before it enters the reduced diameter outlet bushing 7 and into the tailpipe (not shown) or other part of an exhaust system. Thus, the gas flows in a triflow or retroverted main flow stream gas path as it moves from the inlet to the outlet of the muffler.

The longitudinal flow reversals, the abrupt changes in gas passage width, the separation into two streams and recombination into one stream, as just described, all serve to absorb acoustic energy from the exhaust gas flowing through muffler and to attenuate sound in it across a wide range of frequencies. In addition, the multiplicity of small, transverse, necked cross bleed openings 39 permit transverse cross bleed (not main stream) flow of gas from one longitudinal passage to another, helping to minimize back pressure and smooth flow and also serving to attenuate high frequencies, noise and roughness in the gas. The openings 39 can be of two or more diameters, if desired. The annular lips 45 act as tuning necks in a known manner to facilitate attenuation of higher frequencies.

The frame 11 can be made small enough in diameter to fit into small size housings 3. For example, a very commerical size for the automotive replacement market is 3½ inches. A round muffler of this size has the sporty appearance and space saving of a glass pack muffler but its triflow internal construction provides positive sound control comparable to that of a regular line, conventional (generally oval) muffler.

Figure 2:
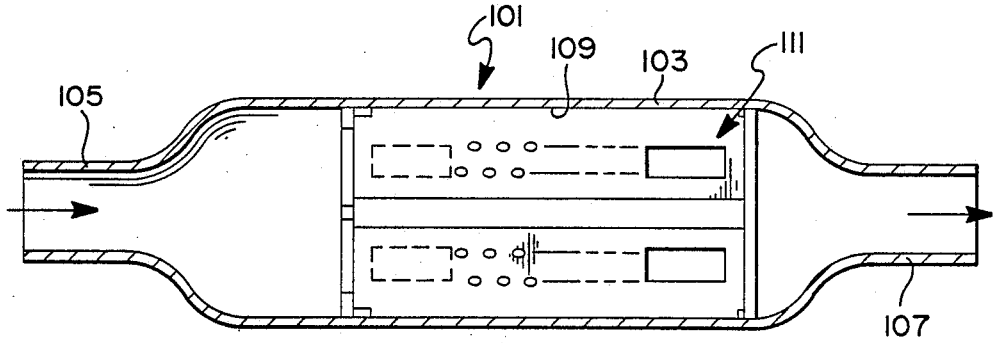
FIG. 2 is a view similar to FIG. 1 but showing a smaller frame that is located closer to the outlet to provide an enlarged inlet chamber in the muffler.

Mufflers according to the invention are application specific but only relatively minor modifications are required to enable a very limited number of mufflers to provide replacement coverage for a much larger number of regular line mufflers. FIG. 2, for example, schematically shows a muffler 101 that is closely related to but stil somewhat different from muffler 1. This muffler has a housing 103 with a swaged inlet bushing 105 and a swaged outlet bushing 107 which are at opposite ends of the internal chamber 109. The frame 111, corresponding in all ways except length to frame 11, is positioned in chamber 109 so that it is spaced much closer to outlet bushing 107 than to the inlet bushing 105. This leaves a relatively long part of chamber 109 to be traversed by gas before it reaches the triflow flow system provided by frame 111. This part of chamber 109 therefore serves as a relatively large volume expansion chamber that is encountered by gas entering the housing and acts to remove significant sound energy. It is clear that while maintaining the same diameter muffler many changes in volume can be obtained simply by changing the length of the housing 103 and many variations in acoustic performance can be obtained simply by changing the length of the frame 111.

Figure 3:
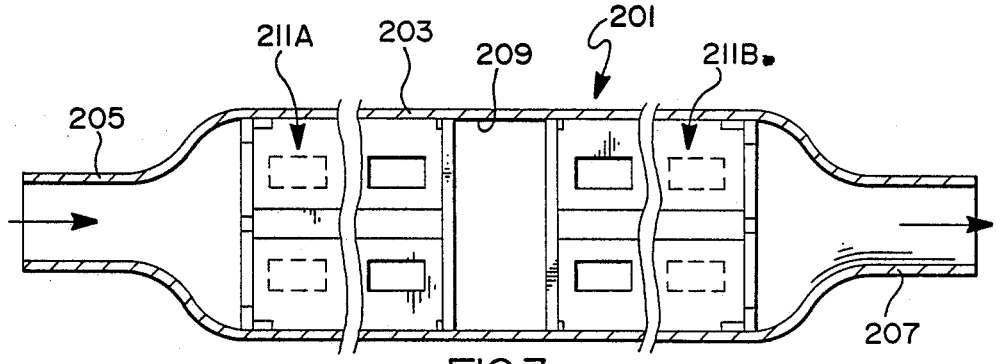
FIG. 3 is a view similar to FIG. 1 but showing the use of two symmetrically arranged frames.

FIG. 3 schematically shows a muffler 201 which illustrates that more than one frame may be used in a housing. Muffler 201 has a housing 203 with swaged down inlet and outlet bushings 205 and 207 at opposite ends of internal chamber 209. A first frame 211A, corresponding to frames 11 and 111, is located in chamber 209 adjacent the inlet bushing 205 and inserted into the housing 203 from the left or inlet end before swaging of bushing 205. A second frame 211B is located in chamber 209 adjacent to the outlet bushing 207 and leaving a space in chamber 209 between it and frame 211A. It is identical to the other frames in construction but it is reversed end for end in orientation thereby enabling it to be readily stuffed into housing 203 from the right or outlet end prior to swaging of the outlet bushing 207. Gas flowing through muffler 201 is therefore subjected to the effects of retroverted flow caused by frame 211A, expansion and contraction provided by that part of chamber 209 between the frame 211A and the frame 211B, and a second retroverted flow system provided by frame 211B. The double triflow system of muffler 201 can provide effective sound removal in difficult applications.

Even though not illustrated, it is apparent that to suit an application one or both of the inlet and outlet bushings can be made longer or shorter and can be formed on an angle so that it is non-axial.

The invention therefore provides a muffler construction which is relatively simple from the standpoint of manufacturing but very effective from the standpoint of performance. From the standpoint of automotive/motor vehicle replacement marketing, it is of an optimum appearance and can be easily changed in internal and/or external dimensions (or by the addition of one or more frames) to suit a wide range of applications.

Modifications may be made without departing from the spirit and scope of the invention.

What is claimed is:

1. A sound attenuating muffler for exhaust gas or the like comprising an elongated tubular housing of round cross section having an inlet at one end and an outlet at the other end and a frame inside the housing constructed and arranged to act with the housing to provide a retroverted path for gas to flow in flowing from the inlet to the outlet, said frame comprising a first transverse partition and a second transverse partition, said transverse partitions extending diametrically across and fitting inside of the housing, said first partition having a substantially imperforate wall with an opening for gas to flow through it, said second partition having a substantially imperforate wall with an opening for gas to flow through it, a first longitudinal partition secured to said first and second transverse partitions, said first partition being substantially trough-shaped with the base of the trough being located substantially adjacent and parallel to the longitudinal axis of the housing, said first longitudinal partition having one end aligned with the opening in the first transverse partition and the other end aligned with the wall of the second transverse partition, a second longitudinal partition secured to said first and second transverse partitions, said second longitudinal partition being substantially trough-shaped with the base of the trough being located substantially adjacent and parallel to the longitudinal axis of the housing, the trough shape of said first longitudinal partition defining a first longitudinal gas passage, the trough shape of said second longitudinal partition defining a second longitudinal gas passage, the space in said housing between said first and second transverse partitions and outside of said trough-shaped first and second longitudinal partitions defining a third longitudinal gas passage, one of said second and third longitudinal gas passages being connected at one end with the opening in said second transverse partition, and gas flow openings located between the first and second transverse partitions providing for transverse gas flow from the downstream end of one longitudinal gas passage to the upstream end of another longitudinal passage whereby said first, second, and third longitudinal gas passages provide said retroverted path for gas to follow in flowing from the inlet to the outlet.

2. A muffler as set forth in claim 1 wherein the ends of the frame are located substantially equal distances from said inlet and outlet.

3. A muffler as set forth in claim 1 wherein one of said transverse partitions is located closer to one of said inlet and outlet than the other of said transverse partitions is to the other of said inlet and outlet.

4. A muffler as set forth in claim 1 wherein a second frame is located in said housing in longitudinal alignment with the aforementioned frame, said second frame being constructed and arranged to act with the housing to provide a second retroverted path for gas to follow in flowing from the inlet to the outlet.

5. A sound attenuating muffler for exhaust gas or the like comprising an elongated tubular housing having an inlet at one end and an outlet at the other end, a first frame inside the housing constructed and arranged to act with the housing to provide a first retroverted path for gas to follow in flowing from the inlet to the outlet, and a second frame inside the housing and longitudinally aligned with the first frame and constructed and arranged to act with the housing to provide a second retroverted flow path for gas to follow in flowing from the inlet to the outlet, each frame comprising first and second transverse partitions extending diametrically across and fitting inside of the housing, each frame further comprising first and second longitudinal partitions secured to said first and second transverse partitions, said frames comprising subassemblies of said transverse partitions and said longitudinal partitions capable of being inserted as units through at least one end of said housing prior to formation of at least one of said inlet and outlet.

6. A muffler as set forth in claim 1 wherein said first transverse partition is located on the inlet end of the frame and the second transverse partition is located on the outlet end of the frame whereby the upstream end of said first longitudinal gas passage is connected to said inlet through said opening in the first transverse partition.

7. A muffler as set forth in claim 6 wherein said second longitudinal partition has its downstream end aligned with the opening in the second transverse partition and its upstream end aligned with the wall of the first transverse partition whereby said second longitudinal gas flow passage is connected to said outlet through said opening in said second transverse partition, said third longitudinal gas flow passage comprising the space in said housing outside of said first and second longitudinal partitions.

8. A muffler as set forth in claim 7 wherein said first and second longitudinal partitions are of identical construction and arranged back to back and reversed end for end in said housing.

9. A muffler as set forth in claim 8 wherein said first and second transverse partitions are of identical construction and arranged to dispose their respective openings in different angular positions with respect to the axis of the housing.

10. A muffler as set forth in claim 9 wherein said first and second transverse partitions have annular flanges at their outer peripheries, said first and second longitudinal partitions being secured at their opposite ends to the imperforate walls of said first and second transverse partitions on radii smaller than the radius of said annular flanges.

11. A muffler as set forth in claim 10 wherein the intersection of each annular flange with the imperforate wall of each transverse partition comprises a circular rounded corner, said first and second transverse partitions being arranged so that the corners of both are on the same longitudinal side to facilitate insertion of the frame into said housing.

12. A muffler as set forth in claim 11 wherein said longitudinal partitions have outer longitudinal side edges formed on radii larger than that of the inside of the housing whereby upon insertion of the frame into the housing said side edges are elastically deflected radially inwardly to provide resilient outward radial pressure on the inside of the housing.

13. A muffler as set forth in claim 12 wherein said outer longitudinal side edges of said longitudinal side edges of said longitudinal partitions terminate inwardly of the ends of the longitudinal partitions whereby said ends can fit inside of the annular flanges of said transverse partitions.

14. A muffler as set forth in claim 8 wherein said longitudinal partitions have transverse tabs at the ends thereof, said tabs being secured to the imperforate walls of said transverse partitions.

15. A muffler as set forth in claim 8 wherein said longitudinal partitions are formed from flat sheet metal blanks and bent into substantially V-shaped cross sections to form said trough-shaped passages.

16. A muffler as set forth in claim 10 wherein said longitudinal partitions are secured to each other in back to back engagement.

17. A muffler as set forth in claim 16 wherein said longitudinal partitions and said transverse partitions form a subassembly capable of being inserted as a unit into one end of said housing prior to formation of at least one of said inlet and outlet.

18. A muffler as set forth in claim 15 wherein the gas flow openings for transverse gas flow from one longitudinal gas passage to another comprise main stream gas flow ports formed in each side of said V-shaped section at one end of the partition.

19. A muffler as set forth in claim 8 wherein said space comprises a first longitudinal portion between the sides of the first and second longitudinal partitions and a second longitudinal portion between the sides of the first and second longitudinal partitions, said first and second longitudinal partitions being in back to back engagement along the lengths thereof and such engagement transversely separating said first longitudinal portion from said second longitudinal portion, said first and second longitudinal portions acting together to form said third longitudinal gas passage.

20. A muffler as set forth in claim 19 wherein the gas flow openings for transverse flow from one gas passage to another comprise gas flow ports formed in each side of the longitudinal partitions at an end thereof.

* * * * *